US006553948B1

(12) United States Patent
Luo

(10) Patent No.: US 6,553,948 B1
(45) Date of Patent: Apr. 29, 2003

(54) WATER HEATER

(76) Inventor: Chin-Kuang Luo, 5F, No. 56, Min-Chuan Rd., Chung Dist., Taichung City (TW)

( * ) Notice: Subject to any disclaimer, the term of this patent is extended or adjusted under 35 U.S.C. 154(b) by 0 days.

(21) Appl. No.: 10/147,706

(22) Filed: May 17, 2002

(30) Foreign Application Priority Data

Dec. 31, 2001 (TW) ..... 90133392 A

(51) Int. Cl.[7] ..... F24H 1/34

(52) U.S. Cl. ..... 122/18.1; 122/18.2; 122/18.31; 392/447; 392/458

(58) Field of Search ..... 122/13.01, 18.1, 122/18.2, 18.3, 18.31, 18.4, 19.1, 19.2, 4 A; 392/444, 447, 441, 458

(56) References Cited

U.S. PATENT DOCUMENTS 5,216,215 A * 6/1993 Walker et al. ..... 219/630

6,132,823 A 10/2000 Qu ..... 428/34.6

* cited by examiner

*Primary Examiner*—Jiping Lu
(74) *Attorney, Agent, or Firm*—Trop, Pruner & Hu, P.C.

(57) ABSTRACT

In a water heater, an outer casing includes a hollow flue tube that extends vertically from an inner periphery of a bottom wall thereof, and an outer surrounding wall that extends uprightly from an outer periphery of the bottom wall and that cooperates with the flue tube to confine a receiving space. A heat-conducting unit is mounted inside the receiving space so as to configure the receiving space with isolated first and second chambers. The first chamber is filled with a thermal superconductor material. The second chamber is adapted for holding water therein. The heat-conducting unit includes a plurality of interconnected upright tubular members that cooperate with the outer casing to confine the first chamber therein. The second chamber is disposed externally of the tubular members. A heat-generating source is mounted below the outer casing for heating the water inside the second chamber.

19 Claims, 9 Drawing Sheets

WATER HEATER

CROSS-REFERENCE TO RELATED APPLICATION

This application claims priority of Taiwan Patent Application No. 90133392, filed on Dec. 31, 2001.

BACKGROUND OF THE INVENTION

1. Field of the Invention

The invention relates to a water heater, more particularly to a water heater that efficiently conducts heat from a heat-generating source to water channeled therethrough.

2. Description of the Related Art

A conventional water heater is used to heat water in a water tank using a gas burner or an electric heating element. As heat transfer in the conventional water heater takes place mainly at the bottom portion of the water tank that is in direct contact with the gas burner or heating element, it takes a relatively long time to heat the water in the water tank, which means large consumption of heat energy. This is not economically desirable in view of the trend toward energy conservation.

SUMMARY OF THE INVENTION

Therefore, the main object of the present invention is to provide a water heater that has a high heat-conducting efficiency to reduce energy consumption.

According to one aspect of the invention, a water heater comprises:

a heat-conducting assembly including:

an outer casing including a bottom wall that is formed with a bottom hole and that has an outer periphery and an inner periphery confining the bottom hole, a hollow flue tube that extends vertically from the inner periphery, and an outer surrounding wall that extends uprightly from the outer periphery and that cooperates with the flue tube to confine a receiving space with a top opening, and a heat-conducting unit mounted inside the receiving space of the outer casing so as to configure the receiving space with isolated first and second chambers, the first chamber being filled with a thermal superconductor material, the second chamber being adapted for holding water therein, the heat-conducting unit including a plurality of interconnected upright tubular members that cooperate with the outer casing to confine the first chamber therein, the second chamber being disposed externally of the tubular members, each of the tubular members having a closed upper end; and a heat-generating source mounted below the heat-conducting assembly for heating the water inside the second chamber.

According to another aspect of the invention, a device for heating water includes:

an outer casing including a bottom wall having an outer periphery, and an outer surrounding wall that extends uprightly from the outer periphery and that cooperates with the bottom wall to confine a receiving space with a top opening, and a heat-conducting unit mounted inside the receiving space of the outer casing so as to configure the receiving space with isolated first and second chambers, the first chamber being filled with a thermal superconductor material, the second chamber being adapted for holding water therein, the heat-conducting unit including a plurality of interconnected upright tubular members that cooperate with the outer casing to confine the first chamber therein, the second chamber being disposed externally of the tubular members, each of the tubular members having a closed upper end.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
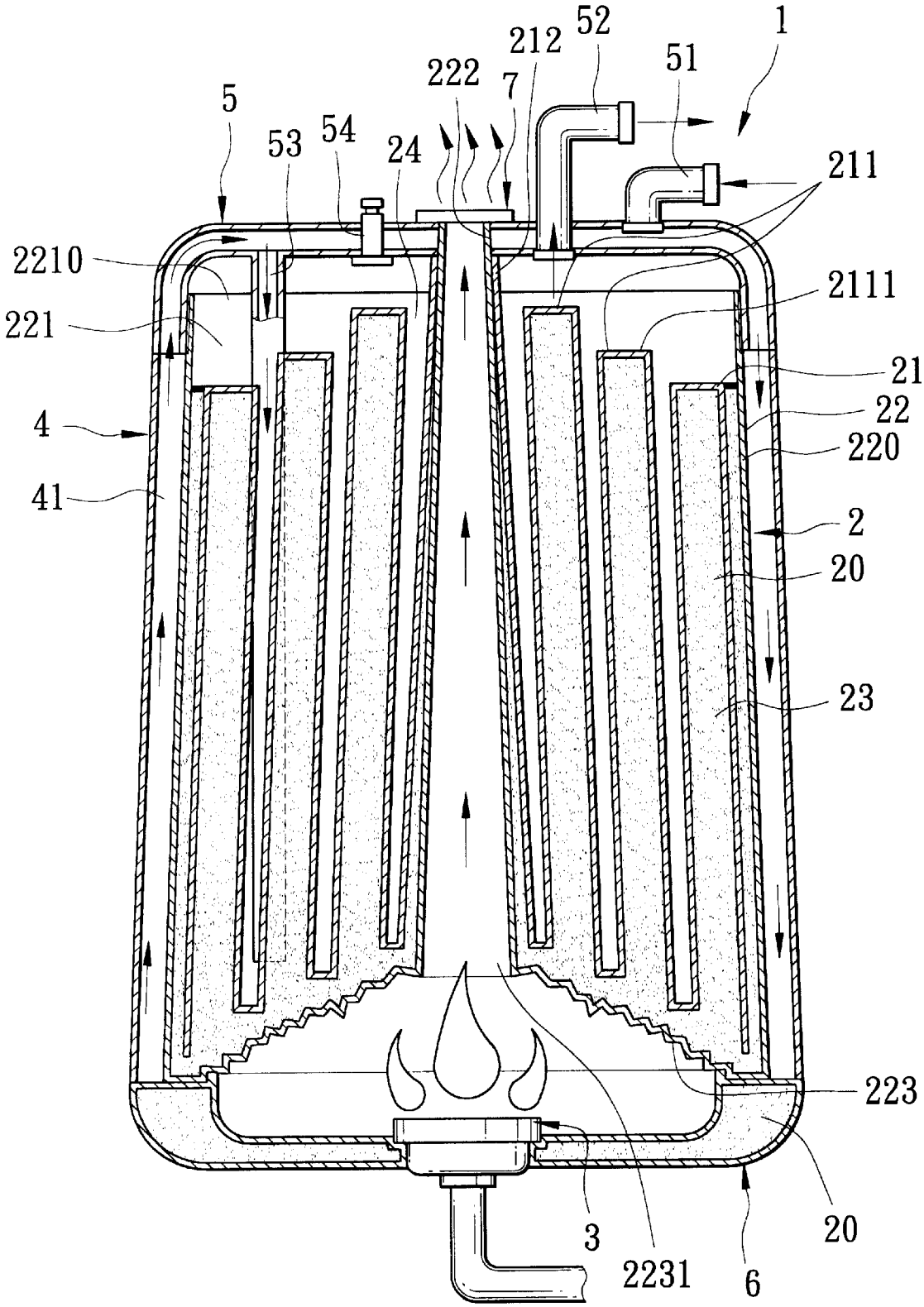
FIG. 1 is a partly sectional view of the first preferred embodiment of a water heater according to the invention.

Before the present invention is described in greater detail, it should be noted that like elements are denoted by the same reference numerals throughout the disclosure.

Figure 2:
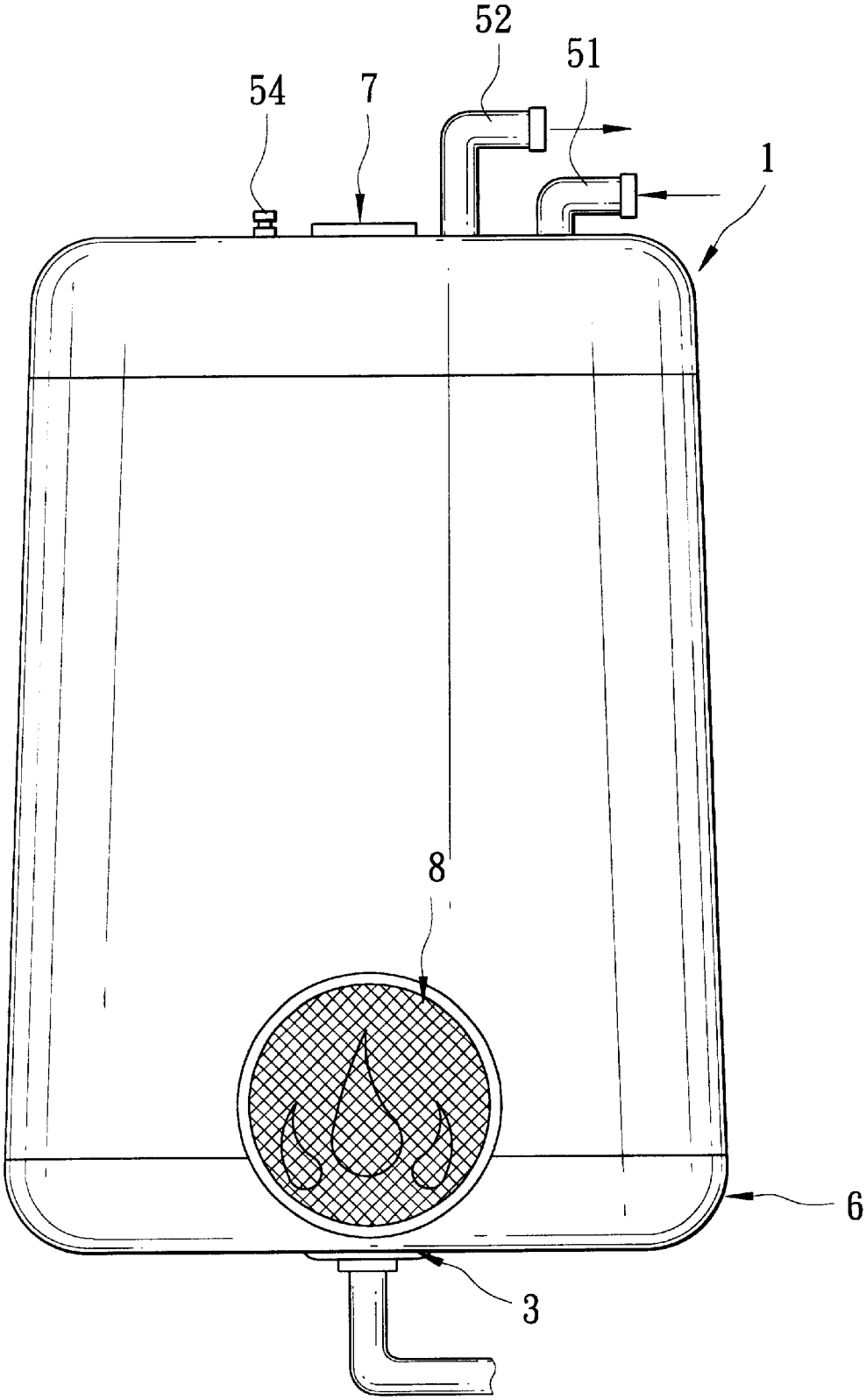
FIG. 2 is a schematic front view of the first preferred embodiment.

Referring to FIGS. 1 and 2, the first preferred embodiment of a water heater 1 according to the present invention is shown to include a heat-conducting assembly 2 and a heat-generating source 3.

The heat-conducting assembly 2 includes a cylindrical outer casing 22 and a heat-conducting unit 21. The outer casing 22 includes a sloping, stepped bottom wall 223 that is formed with a bottom hole 2231 and that has an outer periphery and an inner periphery confining the bottom hole 2231, a hollow flue tube 222 that extends vertically from the inner periphery, and an outer surrounding wall 220 that extends uprightly from the outer periphery and that cooperates with the flue tube 222 to confine a receiving space 221 with a top opening 2210.

Figure 3:
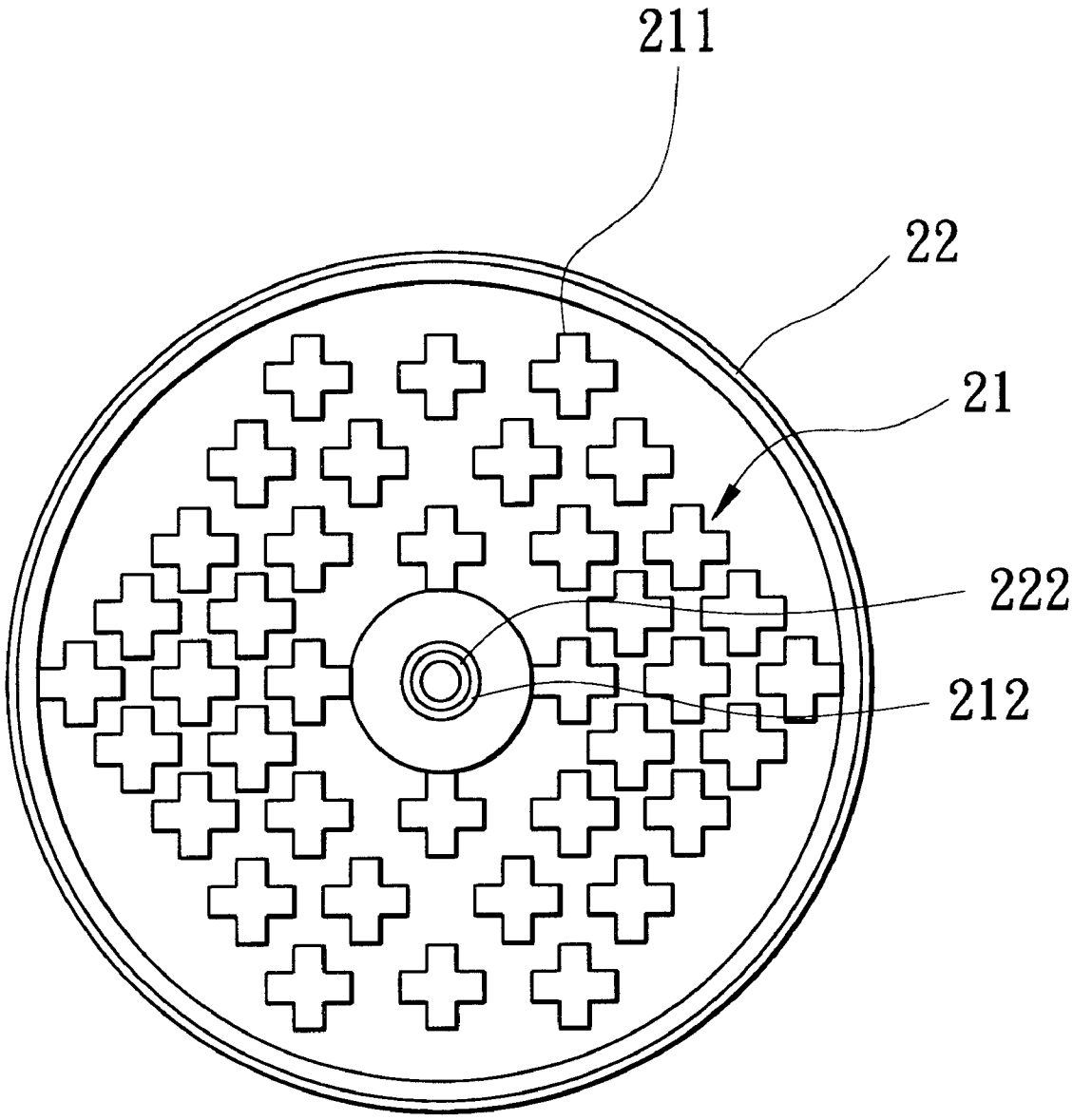
FIG. 3 is a top view of a heat-conducting assembly of the first preferred embodiment, showing a heat-conducting unit having tubular members with a cross-shaped cross section.
Figure 4:
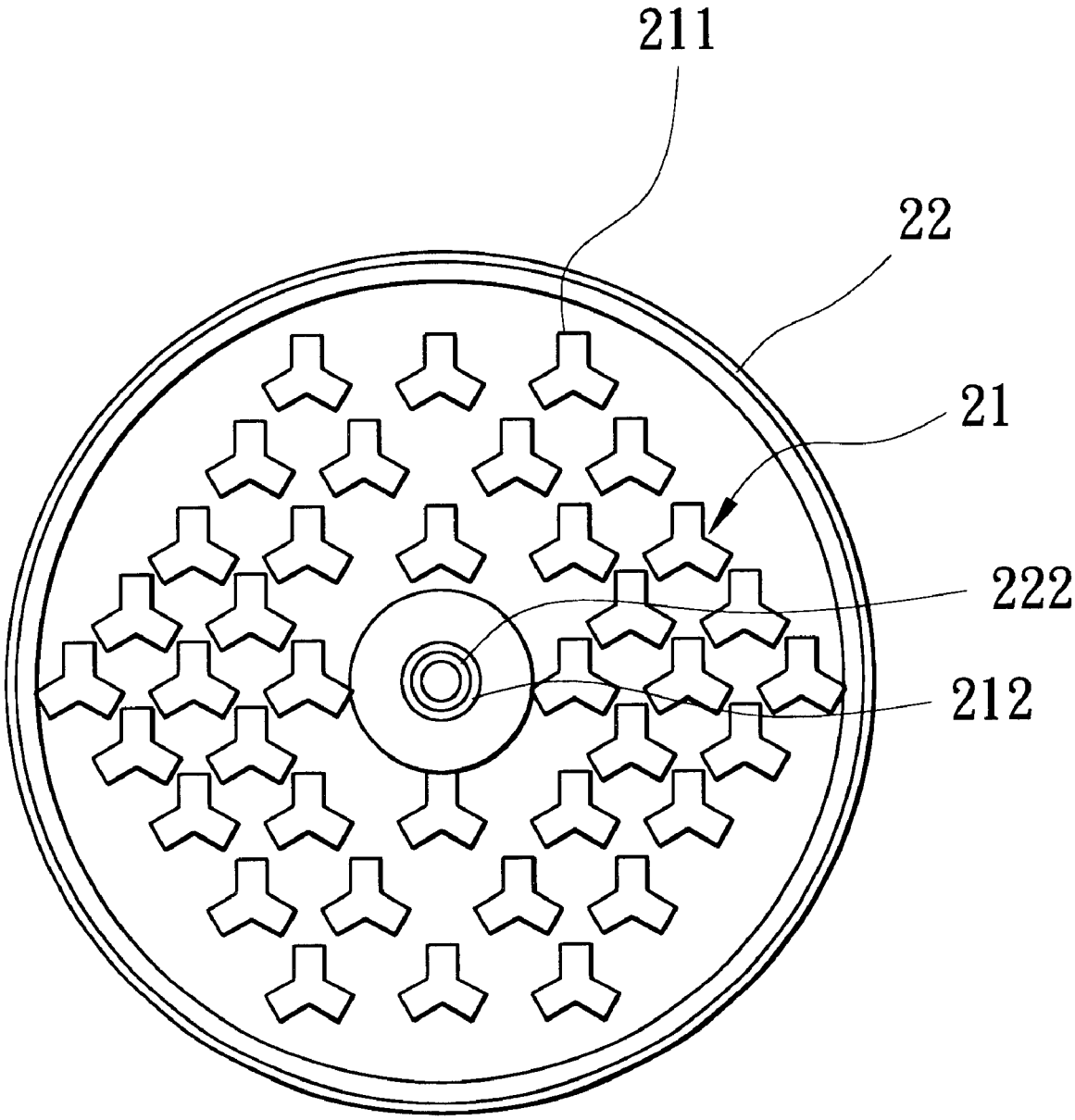
FIG. 4 is a view similar to FIG. 3, but showing tubular members with a Y-shaped cross-section.
Figure 5:
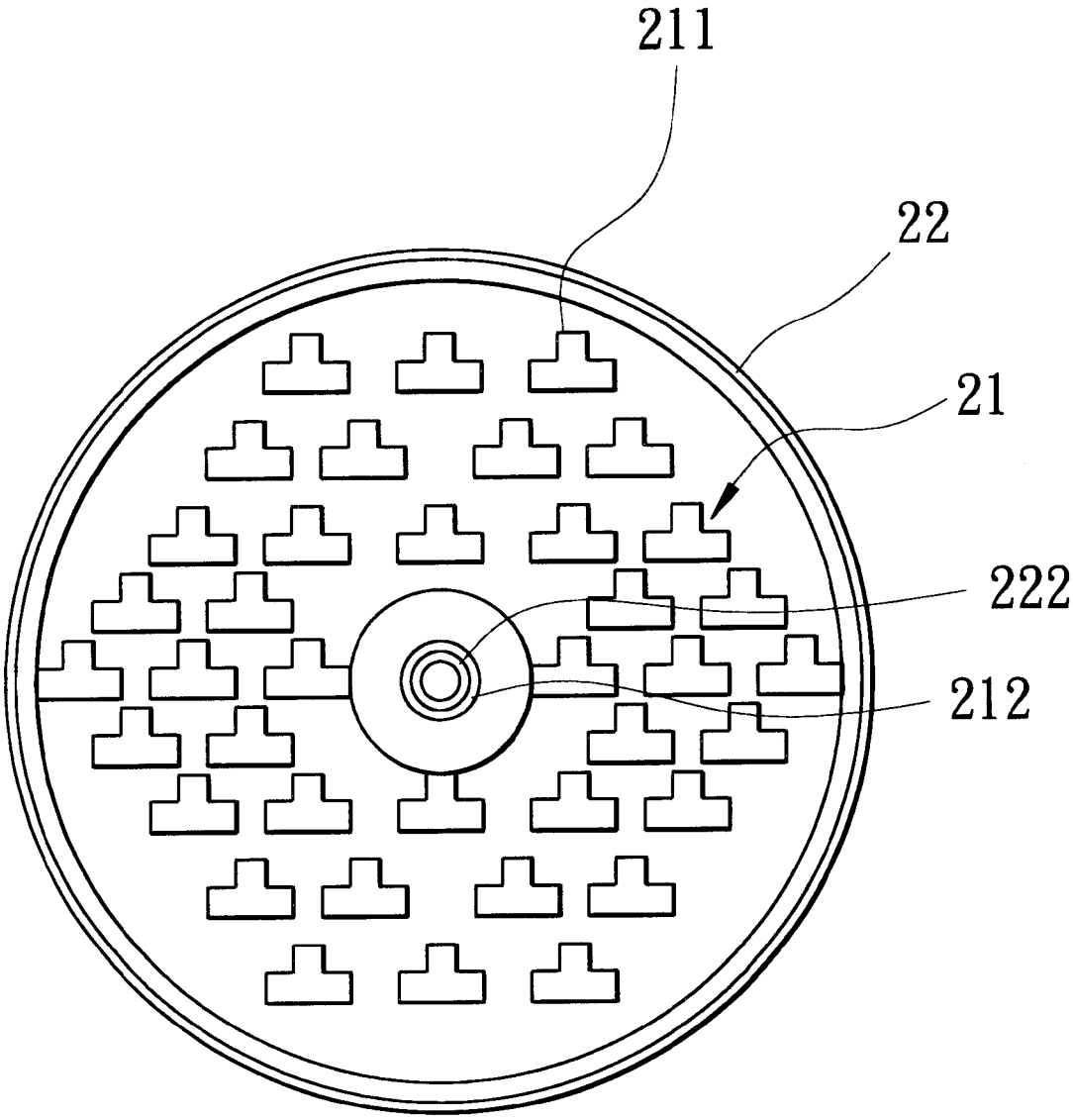
FIG. 5 is a view similar to FIG. 3, but showing tubular members with a T-shaped cross-section.
Figure 6:
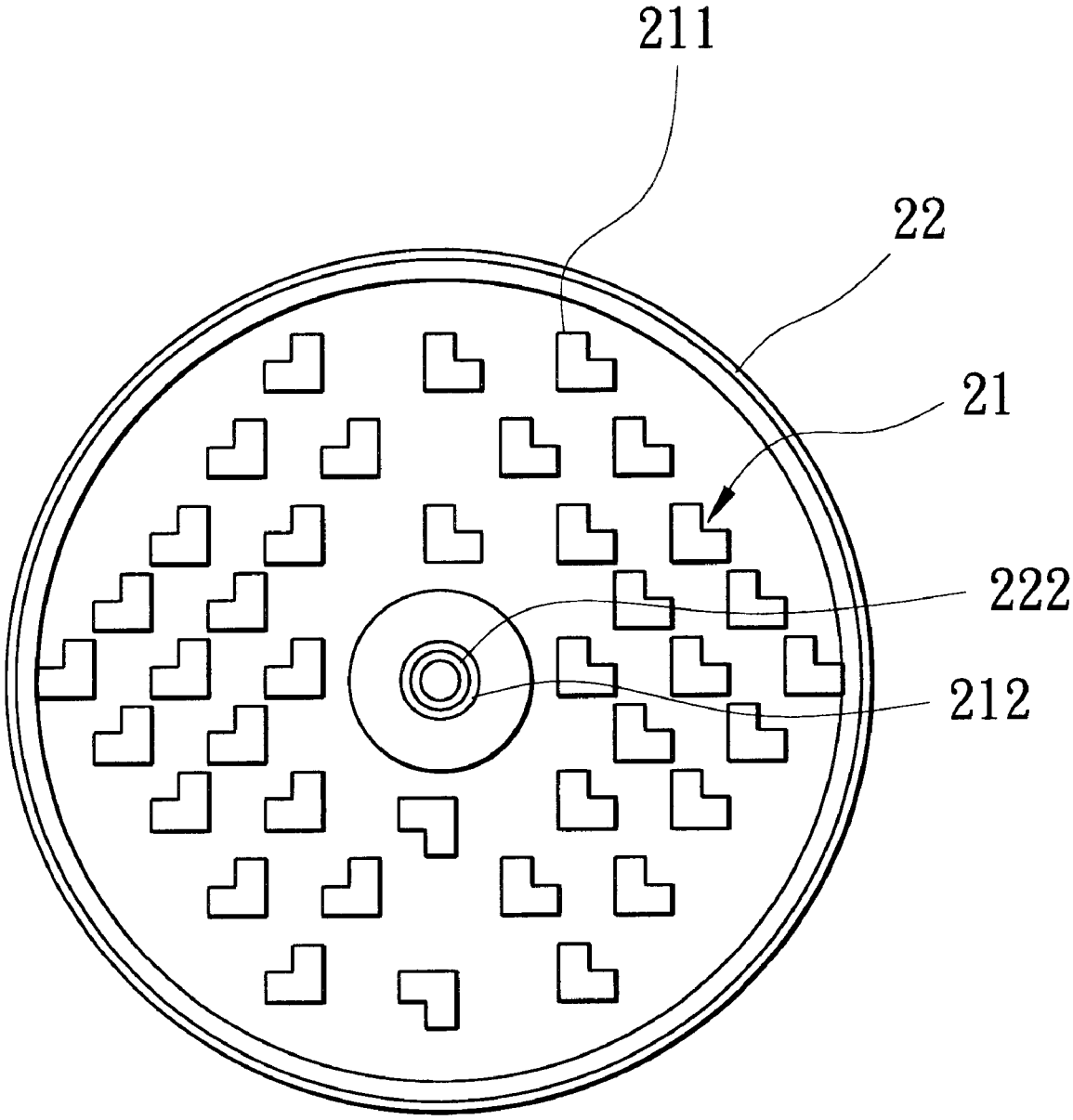
FIG. 6 is a view similar to FIG. 3, but showing tubular members with an L-shaped cross-section.

The heat-conducting unit 21 is mounted inside the receiving space 221 of the outer casing 22 so as to configure the receiving space 221 with isolated first and second chambers 23, 24. The first chamber 23 is filled with a thermal superconductor material 20. The second chamber 24 is adapted for holding water therein. It is noted that the thermal superconductor material 20 is an inorganic superconductor material formed from inorganic elements so as to inhibit generation of hydrogen and oxygen molecules to thereby avoid possible explosion. Preferably, the outer casing 22 and the heat-conducting unit 21 are formed from a material that is non-radioactive, non-toxic, non-corrosive, and non-polluting, and that can be a metal material, such as copper, aluminum, or alloys, or any other material with good heat conductivity. The material should preferably have an applicable temperature range from −50° C. to 1700° C. It is also noted that the thermal superconductor material 20 can adhere to inner surfaces of the first chamber 23 when being filled into the vacuum interior of the latter. The heat-conducting unit 21 includes a plurality of upright tubular members 211 that are interconnected at lower ends and that cooperate with the outer casing 22 to confine the first chamber 23 therein. The second chamber 24 is disposed externally of the tubular members 211. Each of the tubular members 211 has a closed upper end 2111, and preferably has an angled cross-section, such as a cross-shaped cross-section shown in FIG. 3, a Y-shaped cross-section shown in FIG. 4, a T-shaped cross-section shown in FIG. 5, or an L-shaped cross-section shown in FIG. 6. In addition, the heat-conducting unit 21 includes a tubular sleeve 212 that is sleeved on the flue tube 222 and that is connected to the tubular members 211 at a lower end thereof.

The heat-generating source 3 is mounted below the heat-conducting assembly 2 for heating the water inside the second chamber 24. In this embodiment, the heat-generating source 3 is a gas burner, but can also be a known electric heating element.

The heat-conducting assembly 2 further includes a cylindrical preheating unit 4 disposed around the outer casing 22. In this embodiment, the preheating unit 4 cooperates with the outer surrounding wall 220 to confine a water conduit 41 that is in fluid communication with the second chamber 24 such that water can be preheated before entering the second chamber 24.

The heat-conducting assembly 2 further includes a top cover 5 mounted on the outer casing 22 to close the top opening 2210. The top cover 5 is provided with a water inlet 51 in fluid communication with the water conduit 41, a water outlet 52 in fluid communication with the second chamber 24, and a pressure relief valve 54. The water conduit 41 extends into the top cover 5, and includes a guiding tube 53 that extends from the top cover 5 toward the bottom wall 223.

The water heater 1 further includes a hollow base 6 that is filled with the thermal superconductor material 20 to conduct the heat produced by the heat-generating source 3 toward the heat-conducting assembly 2 that is mounted on the base 6.

In addition, a vent cover 7 is disposed on top of the flue tube 222. A wire screen 8 is provided in one side of the water heater 1 and is disposed adjacent to the base 6 such that the heat-generating source 3 is visible from the exterior of the water heater 1.

In use, when water enters via the water inlet 51 of the top cover 5 into the water conduit 41 of the preheating unit 4, the water in the water conduit 41 is preheated via the outer casing 22 and the heat-conducting unit 21 before entering the second chamber 24 via the guiding tube 53. By virtue of the thermal superconductor material 20 in the first chamber 23 and by virtue of the configuration of the tubular members 211 that provide a relatively large heat transfer surface area, the heat produced by the heat-generating source 3 can be transmitted quickly and effectively throughout the water inside the second chamber 24 such that heated water is discharged through the water outlet 52.

Figure 7:
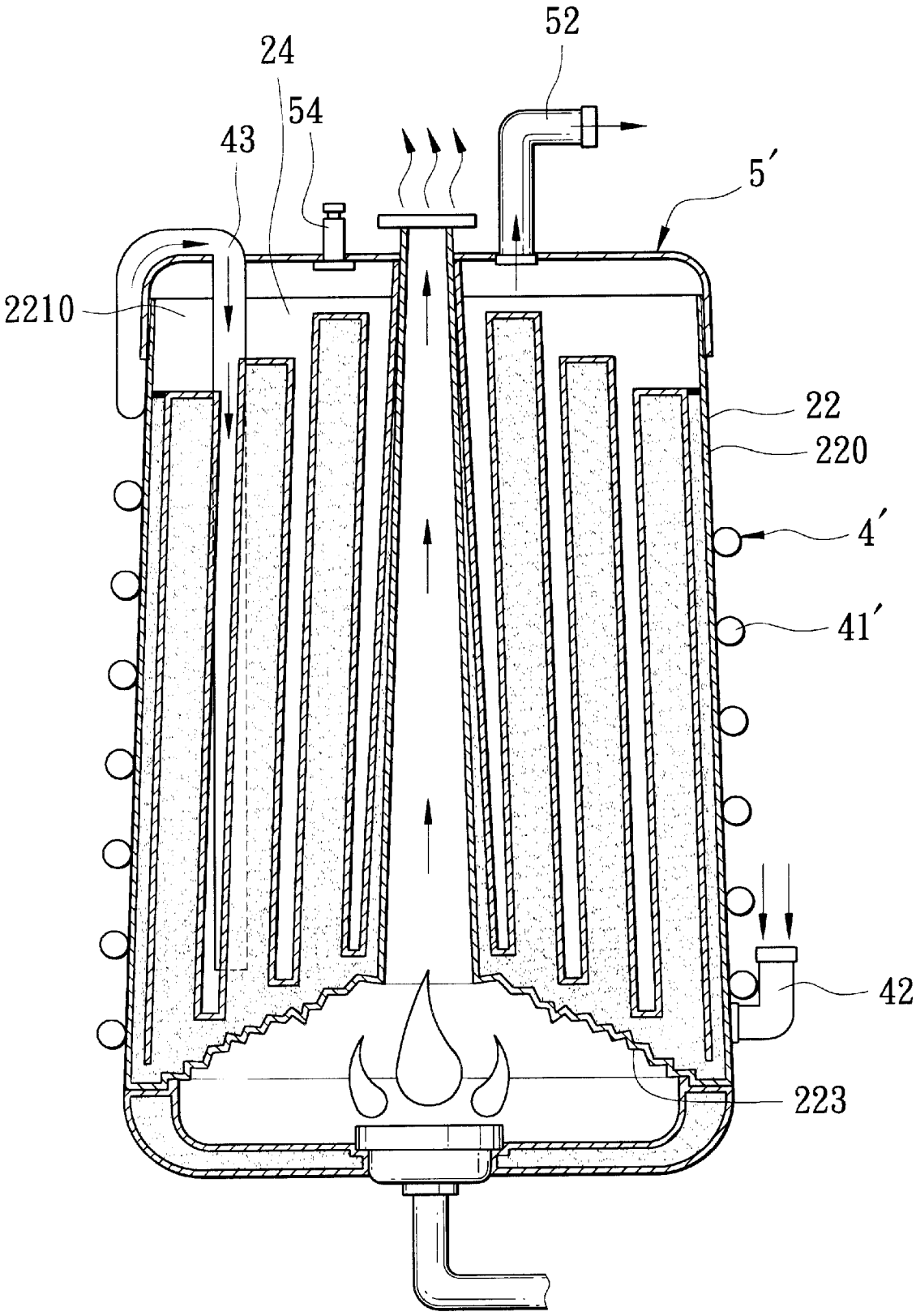
FIG. 7 is a partly sectional view of the second preferred embodiment of a water heater according to the invention.

Referring to FIG. 7, the second preferred embodiment of a water heater according to the invention is shown to be generally similar to the previous embodiment. The major difference between this embodiment and the previous embodiment resides in that the preheating unit 4' includes a water pipe 41' that winds around the outer surrounding wall 220 of the outer casing 22 and that has an inlet end 42 adapted to be coupled to a water source (not shown), and an outlet end 43 extending through a top cover 5' into the second chamber 24, toward the bottom wall 223, and in fluid communication with the second chamber 24. The top cover 5' is mounted on the outer casing 22 to close the top opening 2210, and is provided with a water outlet 52 in fluid communication with the second chamber 24, and a pressure relief valve 54.

Figure 8:
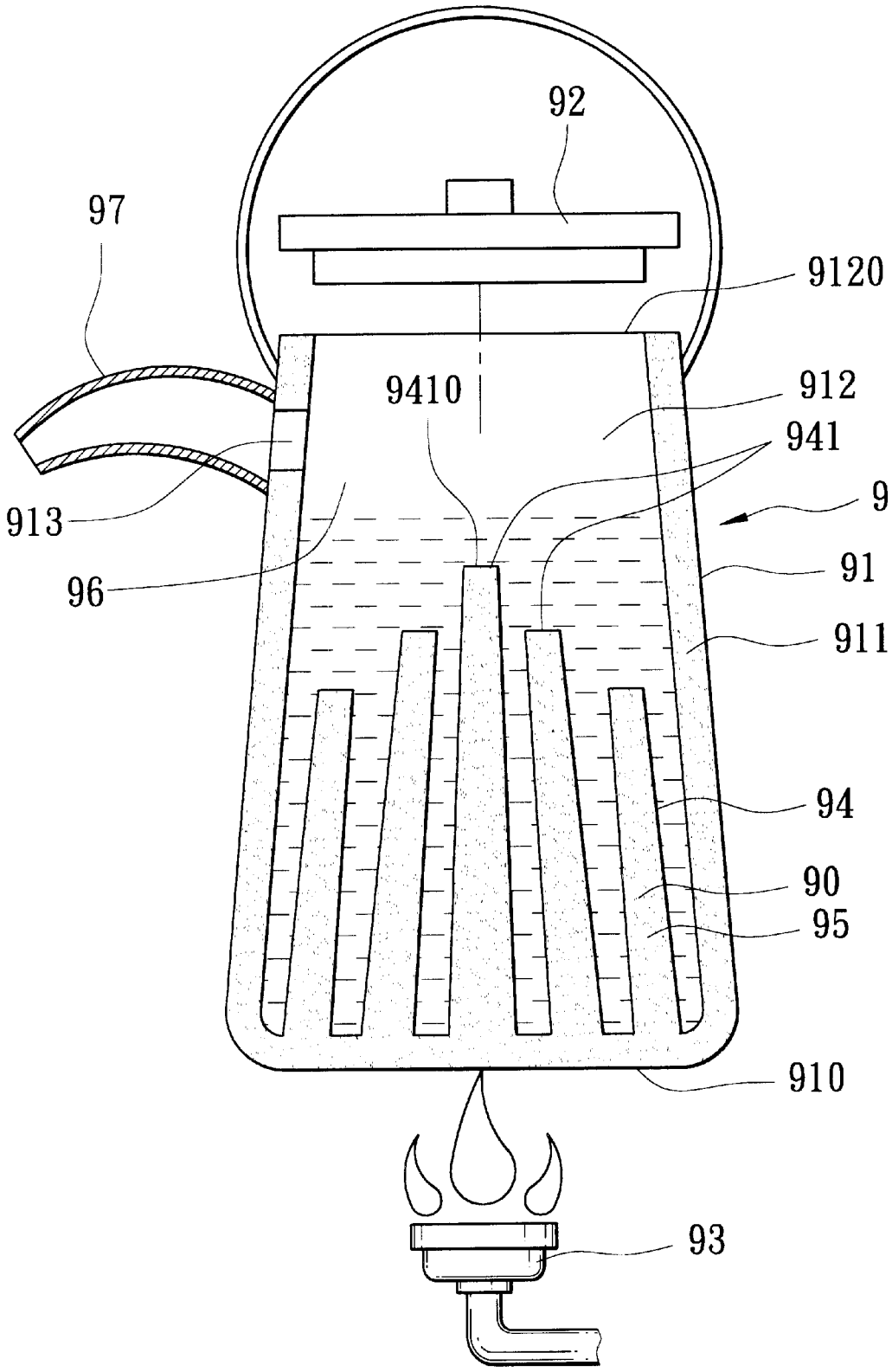
FIG. 8 is a partly sectional view of the third preferred embodiment of a water heater according to the invention.

FIG. 8 shows the third preferred embodiment of a water heater according to the invention. In this embodiment, the water heater is in the form of a water kettle 9, which includes an outer casing 91, a heat-conducting unit 94, and a top cover 92. The outer casing 91 includes a bottom wall 910 having an outer periphery, and an outer surrounding wall 911 that extends uprightly from the outer periphery and that cooperates with the bottom wall 910 to confine a receiving space 912 with a top opening 9120. The heat-conducting unit 94 is mounted inside the receiving space 912 of the outer casing 91 so as to configure the receiving space 912 with isolated first and second 15 chambers 95, 96. The first chamber 95 is filled with a thermal superconductor material 90. The second chamber 96 is adapted for holding water therein. The heat-conducting unit 94 includes a plurality of interconnected upright tubular members 941 that cooperate with the outer casing 91 to confine the first chamber 95 therein. The second chamber 96 is disposed externally of the tubular members 941. Each of the tubular members 941 has a closed upper end 9410. The top cover 92 is mounted removably on the outer casing 91 so as to close the top opening 9120. A spout 97 is connected to the surrounding wall 911, which includes a water outlet 913 that permits fluid communication between the spout 97 and the second chamber 96. Likewise, by virtue of the thermal superconductor material 90 in the first chamber 95 and by virtue of the configuration of the tubular members 941 that provide a relatively large heat transfer surface area, heat produced by a heat-generating source 93 that is disposed below the water kettle 9 can quickly distribute throughout the water inside the second chamber 96.

Figure 9:
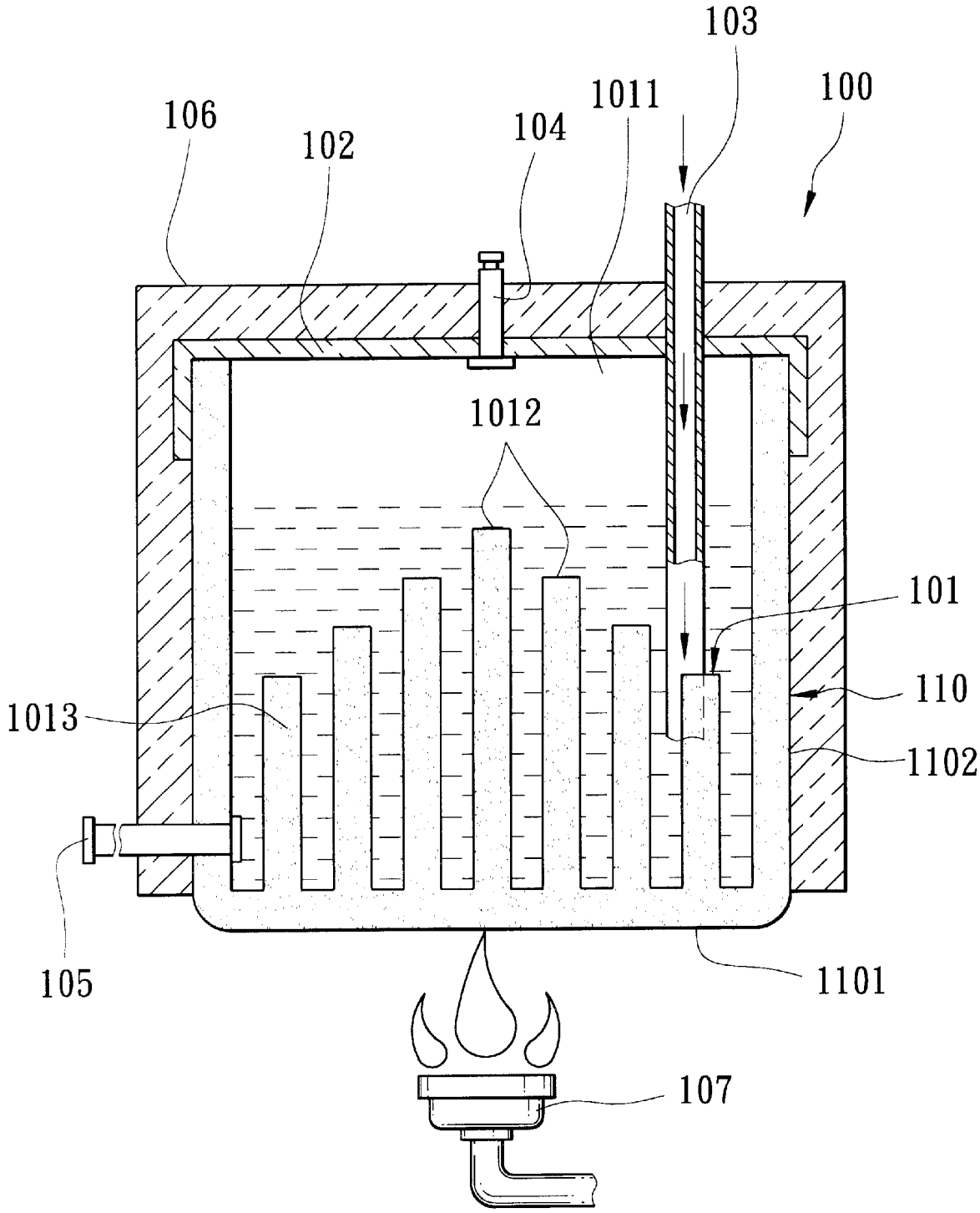
FIG. 9 is a partly sectional view of the fourth preferred embodiment of a water heater according to <he invention.

FIG. 9 shows the fourth preferred embodiment of a water heater according to the invention. In this embodiment, the water heater is in the form of a water boiler 100 that includes an outer casing 110, a heat-conducting unit 101, a top cover 102, and a heat-insulating member 106. As in the third preferred embodiment, the outer casing 110 includes a bottom wall 1101 and a surrounding wall 1102 which cooperates with the bottom wall 1101 to confine a receiving space. The heat-conducting unit 101 is mounted inside the receiving space to configure the receiving space with first and second chambers 1013, 1011, and includes a plurality of interconnected upright tubular members 1012. A heat-generating source 107 is disposed below the water boiler 100 to heat water in the second chamber 1011. In this embodiment, the top cover 102 is mounted on the outer casing 110, and the heat-insulating member 106 is mounted on each of the outer casing 110 and the top cover 102. The top cover 102 is provided with a water inlet 103 that has a first end which extends through the heat-insulating member 106 on the top cover 102 and which is adapted to be coupled to a water source (not shown), and a second end which extends toward the bottom wall 1101. The top cover 102 is further provided with a pressure relief valve 104 that extends through the heat-insulating member 106 on the top cover 102. The surrounding wall 1102 is provided with a water outlet 105 which extends through the heat-insulating member 106 on the outer casing 110 to communicate fluidly with the second chamber 1011. Similarly, this embodiment can achieve the same advantages as those of the previous embodiments.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A water heater, comprising:

a heat-conducting assembly including:

an outer casing including a bottom wall that is formed with a bottom hole and that has an outer periphery and an inner periphery confining said bottom hole, a hollow flue tube that extends vertically from said inner periphery, and an outer surrounding wall that extends uprightly from said outer periphery and that cooperates with said flue tube to confine a receiving space with a top opening, and a heat-conducting unit mounted inside said receiving space of said outer casing so as to configure said receiving space with isolated first and second chambers, said first chamber being filled with a thermal superconductor material, said second chamber being adapted for holding water therein, said heat-conducting unit including a plurality of interconnected upright tubular members that cooperate with said outer casing to confine said first chamber therein, said second chamber being disposed externally of said tubular members, each of said tubular members having a closed upper end; and a heat-generating source mounted below said heat-conducting assembly for heating the water inside said second chamber.

2. The water heater as claimed in claim 1, wherein each of said tubular members has an angled cross-section.

3. The water heater as claimed in claim 1, wherein said thermal superconductor material is an inorganic superconductor material.

4. The water heater as claimed in claim 1, wherein said heat-generating source is an electric heating element.

5. The water heater as claimed in claim 1, wherein said heat-generating source is a gas burner.

6. The water heater as claimed in claim 1, wherein said heat-conducting assembly further includes a preheating unit disposed around said outer casing.

7. The water heater as claimed in claim 6, wherein said preheating unit cooperates with said outer surrounding wall to confine a water conduit that is in fluid communication with said second chamber such that water can be preheated before entering said second chamber.

8. The water heater as claimed in claim 7, wherein said heat-conducting assembly further includes a top cover mounted on said outer casing to close said top opening, said top cover being provided with a water inlet in fluid communication with said water conduit, and a water outlet in fluid communication with said second chamber.

9. The water heater as claimed in claim 8, wherein said water conduit extends into said top cover, and includes a guiding tube that extends from said top cover toward said bottom wall.

10. The water heater as claimed in claim 8, wherein said top cover is further provided with a pressure relief valve.

11. The water heater as claimed in claim 6, wherein said preheating unit includes a water pipe that winds around said outer surrounding wall and that has an inlet end adapted to be coupled to a water source, and an outlet end extending into said second chamber toward said bottom wall and in fluid communication with said second chamber.

12. The water heater as claimed in claim 11, wherein said heat-conducting assembly further includes a top cover mounted on said outer casing to close said top opening, said top cover being provided with a water outlet in fluid communication with said second chamber.

13. The water heater as claimed in claim 12, wherein said top cover is further provided with a pressure relief valve.

14. The water heater as claimed in claim 1, further comprising a hollow base that is filled with the thermal superconductor material, said heat-conducting assembly being mounted on said base.

15. The water heater as claimed in claim 1, wherein said heat-conducting unit further includes a tubular sleeve that is sleeved on said flue tube and that is connected to said tubular members.

16. A device for heating water, comprising:

an outer casing including a bottom wall having an outer periphery, and an outer surrounding wall that extends uprightly from said outer periphery and that cooperates with said bottom wall to confine a receiving space with a top opening, and a heat-conducting unit mounted inside said receiving space of said outer casing so as to configure said receiving space with isolated first and second chambers, said first chamber being filled with a thermal superconductor material, said second chamber being adapted for holding water therein, said heat-conducting unit including a plurality of interconnected upright tubular members that cooperate with said outer casing to confine said first chamber therein, said second chamber being disposed externally of said tubular members, each of said tubular members having a closed upper end.

17. The device as claimed in claim 16, further comprising a top cover mounted removably on said outer casing so as to close said top opening, and a spout connected to said surrounding wall, said surrounding wall including a water outlet that permits fluid communication between said spout and said second chamber.

18. The device as claimed in claim 16, further comprising a top cover mounted on said outer casing, and a heat-insulating member mounted on each of said outer casing and said top cover.

19. The device as claimed in claim 18, wherein said top cover is provided with a water inlet that has a first end which extends through said heat-insulating member on said top cover and which is adapted to be coupled to a water source, and a second end which extends toward said bottom wall, and said surrounding wall is provided with a water outlet which extends through said heat-insulating member on said outer casing to communicate fluidly with said second chamber.

* * * * *